United States Patent [19]

Bresnahan

[11] Patent Number: 4,878,778

[45] Date of Patent: Nov. 7, 1989

[54] CONCRETE PATH PAVER

[76] Inventor: Pat Bresnahan, 3210 W. Woodthrust St., Lecanto, Fla. 32661

[21] Appl. No.: 181,384

[22] Filed: Apr. 14, 1988

[51] Int. Cl.[4] ..... E01C 19/48

[52] U.S. Cl. ..... 404/105; 404/110

[58] Field of Search ..... 404/110, 105, 102, 108, 404/101, 96

[56] References Cited

U.S. PATENT DOCUMENTS

| | | | |
|---|---|---|---|
| 1,767,243 | 6/1930 | Kime | 404/110 |
| 2,332,688 | 10/1943 | Baily | 404/102 |
| 2,664,794 | 1/1954 | Evans | 404/105 |
| 3,246,584 | 4/1966 | Lee | 404/110 |
| 3,456,566 | 7/1969 | Lazaro | 404/108 |
| 3,877,830 | 4/1975 | James, III | 404/110 X |
| 3,989,402 | 11/1976 | James, III | 404/110 |
| 4,609,303 | 9/1986 | Shumaker | 404/105 |
| 4,802,788 | 2/1989 | Smith | 404/105 X |

*Primary Examiner*—Jerome W. Massie
*Assistant Examiner*—Matthew Smith
*Attorney, Agent, or Firm*—Dominik, Stein, Saccocio, Reese, Colitz & Van Der Wall

[57] ABSTRACT

The concrete path paver of the invention comprises a generally rectangular open-ended box having a front wall and an inwardly sloped rear wall rigidly connected between a pair of side walls to define a bottom opening. An adjustable screed is positioned underneath the sloped rear wall from the rearward side of the bottom opening and extends a significant distance beyond the lower edge of the rear wall to form a slip-form mold. A platform is affixed rearwardly of the rear wall above the screed allowing an operator to stand thereon and control the flow of concrete from the cement truck into the box. The concrete path paver further comprises an arcuate or flat plate affixed to the lower front edge of the front wall of the box. The front plate functions as a ski to push and smooth dirt along the path that may have been disrupted by the tires of the cement truck. Thus, the tire tracks made by the cement truck as it pulls the paver are filled in and smoothed over prior to the concrete being laid. Further, the concrete path paver includes a pair of skids affixed along the lower edges of the sides to prevent the edges from digging into the dirt during pulling of the box.

10 Claims, 2 Drawing Sheets

CONCRETE PATH PAVER

BACKGROUND OF THE INVENTION

1. Field of the Invention

This invention relates to paving machines. More particularly, this invention relates to concrete paving machines designed to be pulled behind a cement truck and lay a slip-formed path of concrete on the ground as the concrete is dispensed therein from the cement truck.

2. Description of the Background Art

Presently there exist many types of paving machines designed to lay a path or roadway of concrete or asphalt. Typically, the bed of the path or roadway must be prepared prior to paving so as to provide adequate support for the path or roadway. For heavy roadways, the bed is prepared with aggregate and aggregate compositions to provide great load-bearing support for the roadway when constructed. However, for lighter applications such as gold cart paths in golf courses, the pathway must only be cleared of grass and trees and levelled to a smooth grade.

Prior art asphalt paving machines are disclosed in U.S. Pat. Nos. 3,108,517, 3,246,584, and 2,186,081. Prior art concrete paving machines are disclosed in U.S. Pat. Nos. 1,744,613, 2,899,877, 3,373,669, 4,609,303, 2,664,794 and 2,403,820.

The above-mentioned patents disclose paving machines adapted for specific applications. However, none of the paving machines disclosed are particularly adapted for paving golf cart paths in golf courses. More particularly, in regard to golf cart paths, it is desirable to minimize damage to the grass turf of the golf course except underneath the intended path to be paved. The prior art paving machines, and their related equipment, cannot be contained within the width of the path to be paved; and thus, are undesirable.

Therefore, it is an object of this invention to provide an apparatus which overcomes the aforementioned inadequacies of the prior art devices and provides an improvement which is a significant contribution to the advancement of the concrete paving art.

Another object of this invention is to provide a concrete path paver adapted to be pulled behind a cement truck so as to minimize damage to areas adjacent to the path to be paved.

Another object of this invention is to provide a concrete path paver having a width only appreciably greater than the path to be paved so as to minimize damage to areas other than underneath the cart path.

Another object of this invention is to provide a concrete path paver having an adjustable screed to slip-form a concrete slap of a desired thickness.

Another object of this invention is to provide a concrete path paver having a compact design for slip-forming a concrete slab in a short radius as it is pulled behind the cement truck.

Another object of this invention is to provide a concrete path paver having an arcuate plate formed along its lower front edge to push and level the dirt disrupted by the wheels of the cement truck and to create a ski-like effect to allow the paver to be pulled over the cart path by the cement truck.

Another object of this invention is to provide a concrete path paver having skids mounted along its sides to prevent the paver from sinking into the ground as it is pulled by the cement truck.

The foregoing has outlined some of the more pertinent objects of the invention. These objects and advantages should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. For the purposes of summarizing the invention, the invention comprises a concrete path paver designed to be continuously pulled immediately behind a cement truck and slip-form concrete dispensed from the truck into a concrete slab.

More particularly, the concrete path paver of the invention comprises a generally rectangular open-ended box having a front wall and an inwardly sloped rear wall rigidly connected between a pair of side walls to define a bottom opening. An adjustable screed is positioned underneath the sloped rear wall from the rearward side of the bottom opening and extends a significant distance beyond the lower edge of the rear wall to form a slip-form mold. A platform is affixed rearwardly of the rear wall above the screed allowing an operator to stand thereon and control the flow of concrete from the cement truck into the box.

The concrete path paver further comprises an arcuate or flat plate affixed to the lower front edge of the front wall of the box. The front plate functions as a ski to push and smooth dirt along the path that may have been disrupted by the tires of the cement truck. Thus, the tire tracks made by the cement truck as it pulls the paver are filled in and smoothed over prior to the concrete being laid. Further, the concrete path paver includes a pair of skids affixed along the lower edges of the sides to prevent the edges from digging into the dirt during pulling of the box. The combination of the front plate and the side skids assures that the box remains level, relative to the grade of the path being paved, during pulling. A slab of concrete of uniform thickness is therefore assured.

The width of the concrete path paver is not much greater than the width of the concrete path to be laid. Thus, the cart path may be prepared by simply grading, with a front end loader or the like, the intended path to remove the existing turf and brush. The cement truck is slowly driven within the side boundaries of the path, pulling the concrete path paver behind as it dispenses concrete therein, to slip-form concrete slab. Damage to the turf outside the concrete slab being laid is therefore minimized. Further, turns of sharp radius can be achieved.

It is noted that the cement truck pulling the concrete path paver may itself be pulled by a bull dozer in the event the cement truck cannot be driven at a slow enough speed relative to the flow of concrete into the box to assure that a fully formed concrete slab is laid. Additionally, it is noted that one or more vibrators may be mounted on the sloped rear wall of the box to assure that the concrete in the box flows smoothly into the screed positioned below.

The foregoing has outlined rather broadly the more pertinent and important features of the present invention in order the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects and advantages of the present invention, reference should be had to the present invention, reference should be had to the following detailed description taken in conjunction with the accompanying drawings in which.

Similar referenced characters refer to similar parts throughout the several figures.

DETAILED DESCRIPTION OF THE PREFERRED EMBODIMENT

Figure 1:
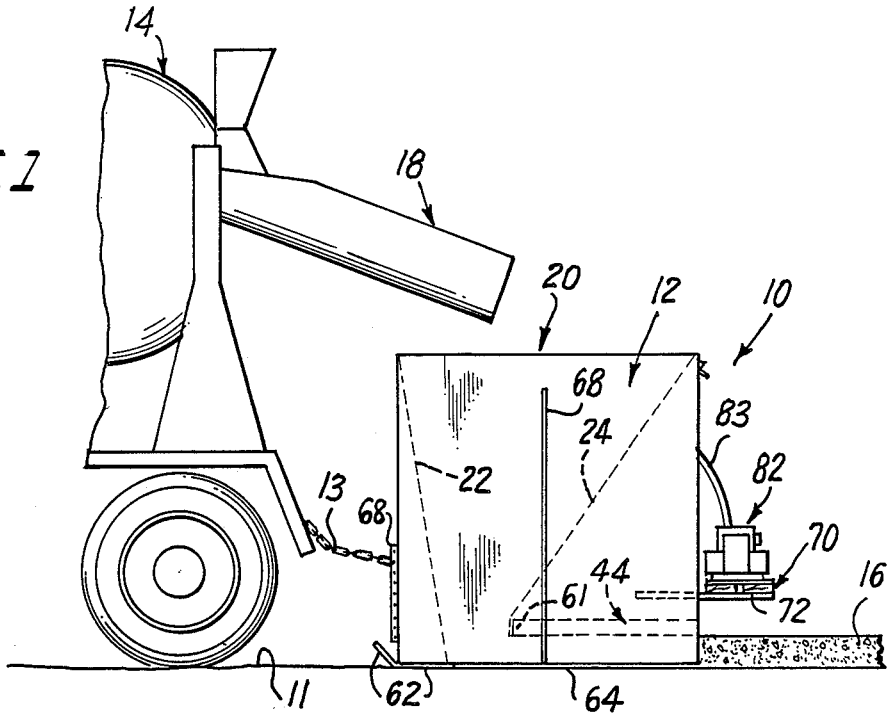
FIG. 1 is a side elevational view of the concrete path paver begin pulled by a cement truck and and slip-forming of concrete dispensed from the truck into a concrete slab to form a concrete golf cart path.

Referring to FIG. 1, the concrete path paver 10 of the invention comprises a generally rectangular box 12 designed to be pulled by a chain 13 connected to a hitch 15 behind a cement truck 14 to slip-form a slab of concrete 16 onto the ground 11 as concrete is dispensed from the chute 18 of the truck 14 into the upper opened end 20 of the box 12.

Figure 2:
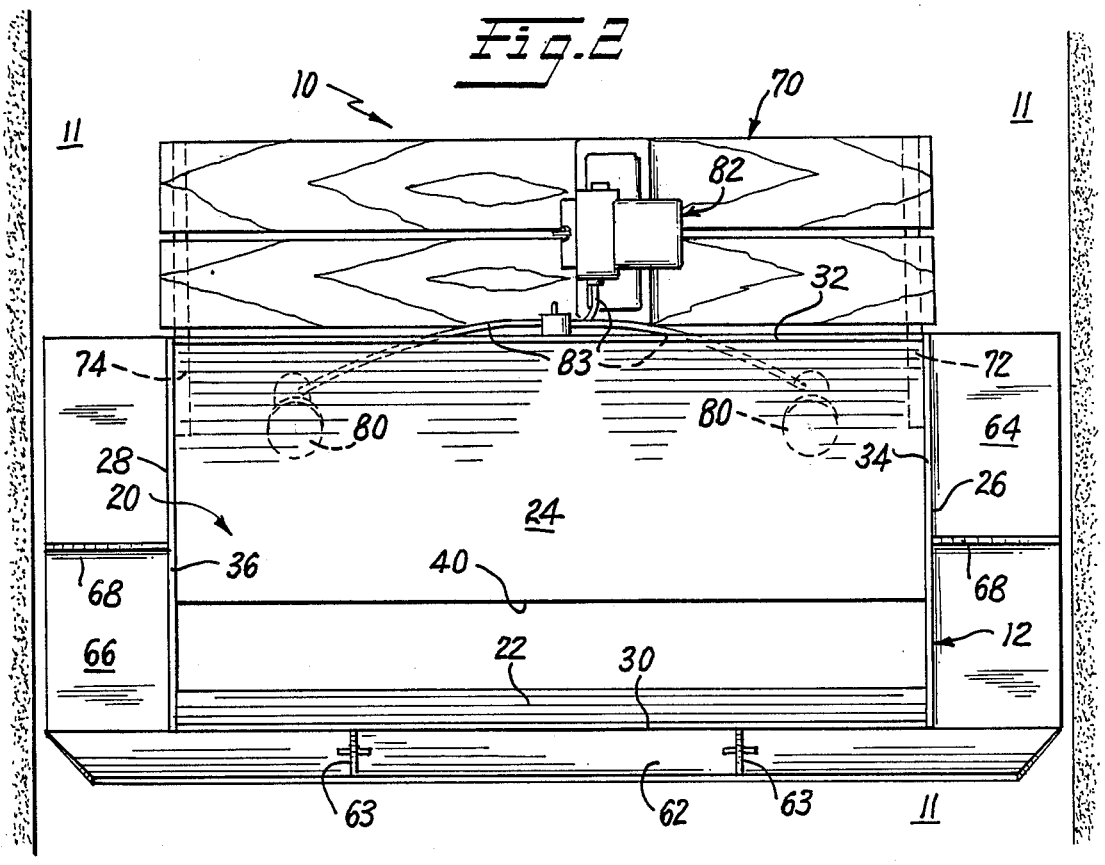
FIG. 2 is top plan view of the concrete path paver to the invention illustrating the upper opened end of the box into which the concrete is dispensed from the cement truck.
Figure 3:
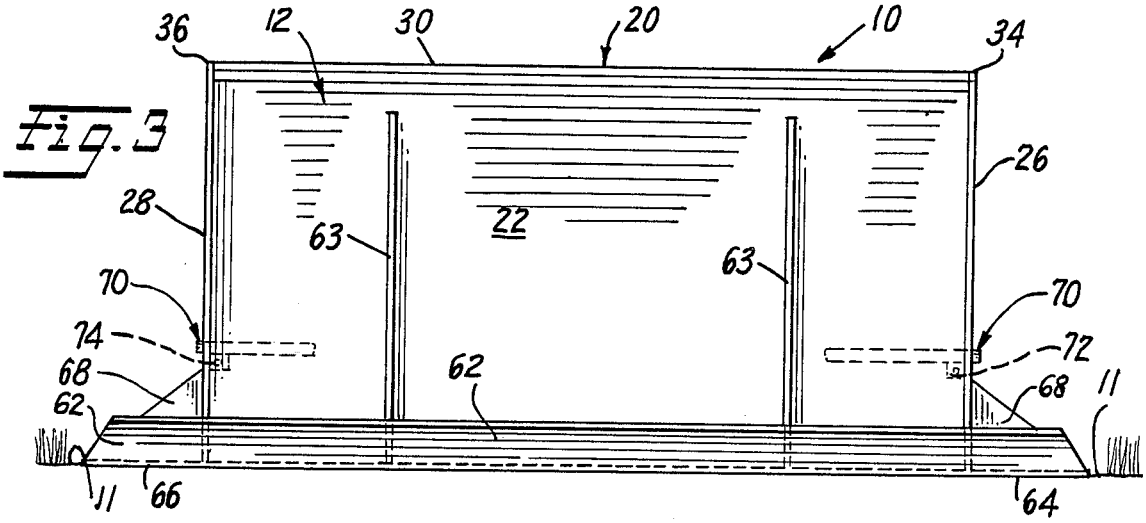
FIG. 3 is a front view of the concrete path paver of the invention illustrating the front plate affixed to the lower edge of the front wall of the box and illustrating the hitch affixed to the front wall allowing a chain to be connected thereto and to the cement truck.
Figure 4:
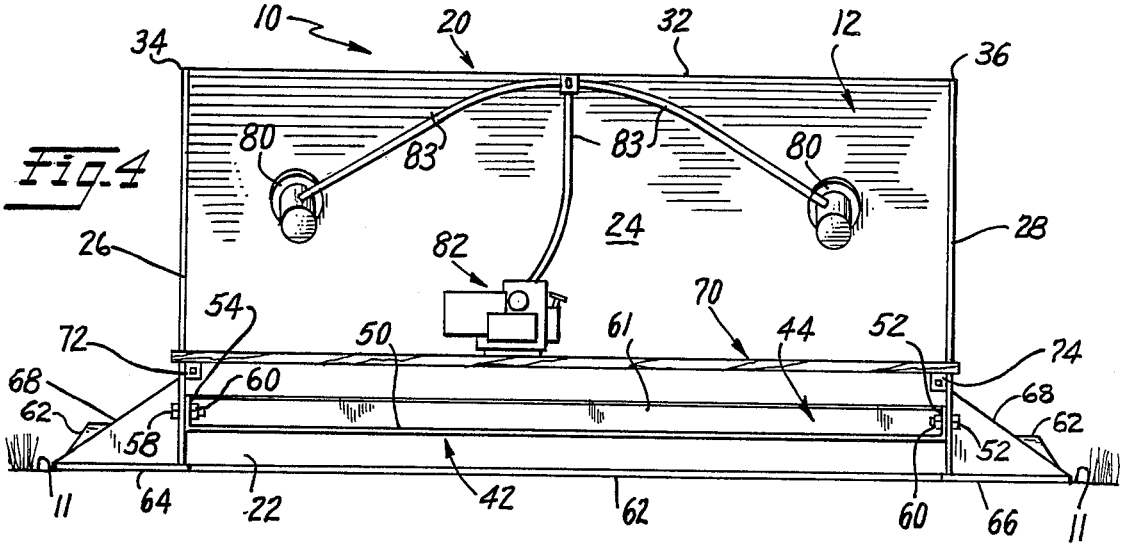
FIG. 4 is a rear view of the concrete path paver of the invention illustrating the vibrators mounted to the rear wall of the box and the gasoline engine/generator used to power the vibrators.
Figure 5:
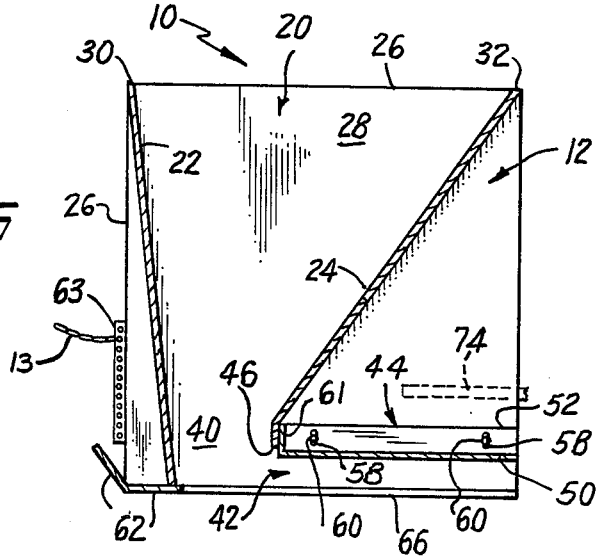
FIG. 5 is a cross-sectional view of FIG. 3 along lines 5—5 illustrating inwardly angled front and rear wall and the lower opening of the box leading into the screed.

As best shown in FIGS. 2 and 5, the upper opened end 20 of the box 12 is defined by an inwardly sloping front and rear walls 22 and 24 rigidly connected between opposing vertical side walls 26 and 28. More particularly, the upper edges 30 and 32 of the front and rear walls 22 and 24 define the depth of the upper opened end 20 and the upper edges 34 and 36 of the side walls 26 and 29 define the width of the upper opened end 20.

The walls 22–28 further define a lower opened end 40 to feed the concrete into the mouth 42 of the screed 44. More specifically, the lower opened end 40 is defined by the lower edge 46 of the rear wall 24 which extends only partially between the opposing side walls 26 and 28 and the lower sides of the front and side walls 22, 26 and 28. The lowermost edges of the front and side walls 22, 26 and 28 extend to the same ground level.

It is noted that the rear wall 24 is sloped at a greater angle than that of the front wall 22 to allow sufficient distance for the screed 44 to be positioned below the rear wall 24 without extending substantially beyond the periphery of the box 12.

The screed 44 comprises a horizontal member 50 having a width to fit between the vertical side walls 26 and 28. The horizontal member 50 is provided with upturned side flanges 52 and 54. Slots 56 are formed in the side flanges 52 and 54. Bolts 58 extend through the side walls 26 and 28 through the slots to be fitted with nuts 60 thereby allowing the horizontal member 50 to be adjusted vertically. The vertical height therefore determines the thickness of the slip-formed concrete slab 16.

It is noted that another upturned flange 61 extends from the front edge of the horizontal member 50 at an angle mating with the angle of tile of the rear wall 24. Thus, a close fit is achieved between the flange 16 and the lowermost edge 46 of the rear wall 24 at all heights of the horizontal member 50. Leakage of concrete therebetween is minimized.

A flange of arcuate plate 62 is affixed to the lowermost side edges of the side walls 26 and 28 to extend fully across the front of the box 12. Angled reinforcements 63 additionally secure the plate 62 to the front wall 22. The plate 62 functions to push dirt as the paver 10 is pulled and to smooth such dirt to fill-in tire tracks or the like. The plate 62 also functions as a "ski" to prevent the front of the box 12 from digging into the dirt instead of sliding along.

A pair of skids 64 and 66 are affixed, with vertical reinforcements 68, to the lowermost edges of the side walls 26 and 28 to extend fully along the length of the side walls 26 and 28 from the plate 62 to the trailing end of the screed 44. The skids 64 and 66 function to prevent the lowermost edges of the side walls 26 and 28 from digging into the ground as the box 12 is pulled by the cement truck 14, without significantly adding to the overall width of the paver 10.

A horizontal platform 70 extends across the rear of the box 12 by means of a pair of brackets 72 and 74. The platform 70 provides a standing area for the operator of the cement truck 14 controlling the flow of concrete into the upper opened end 20 of the box 12.

A pair of vibrators 80 are mounted on the exterior surface of the rear wall 24. The vibrators 80 may be powered by means of a gasoline engine/generator 82 positioned on platform 70 and suitable electric lines 83. The vibrators 80 function to vibrate the rear wall 24 to encourage smooth flowing of concrete, particularly thick concrete.

during use, as concrete flows into the box 12 from the cement truck 14, the concrete is vibrated by vibrators 80, and then flows onto the ground and into the mouth 42 of the screed 44. As the paver 10 is pulled by the truck 14 with concrete continually flowing into the box 12, a slab of concrete 17 is slip-formed by the screed 44 on the ground 11.

After the slab is slip-formed, only minimal smoothing and brushing of the slab is required.

Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described, What is claimed is:

1. A concrete path paver for slip forming a slab of concrete onto a dirt pathway, the upper surface of the dirt pathway constituting a plane of construction, comprising in combination:

a box having a front wall extending downwardly at an angle through the box to the plane of construction, and an inwardly sloping rear wall extending downwardly at an angle through the box to a location above the plane of construction, and opposing side walls coupling the front and rear walls extending downwardly to at least the plane of construction to define a closed box having only an upper opened end for receiving concrete and a lower opened end with a vertically disposed opened mouth defined by the vertical edges of said side walls and the lower horizontal edge of said rear wall, with said lower opened end having a smaller cross-sectional area than said upper opened end;

a fixed screed for slip forming the concrete, means for securing said screed at its edges to said side walls below said rear wall with a mouth of said screen being positioned about said opened mouth of said rear wall;

a plate secured at its edges to said side walls across a lowermost front edge of said box, said plate being upwardly turned to create a ski-like effect upon movement of the paver on the pathway;

a pair of skids affixed to a lowermost edge of said sidewalls of said box causing said box to float upon the pathway during movement of the paver; and hitch means connected relative to said front of said box allowing the paver to be connected immediately behind a cement truck by means of a chain or like such that concrete being dispensed from the chute of the cement truck flows into said upper opened end of said box to fill the same while said screed slip-forms the concrete from said opened mouth of said lower opened end into a concrete slab laid directly on the pathway.

2. The concrete path paver as set forth in claim 1, wherein said screed comprises an upturned front edge for mating engagement with a lower edge of said inwardly sloping rear wall.

3. The concrete path paver as set forth in claim 2, further comprising means for adjusting the vertical height of said screed relative to said mouth of said lower opened end allowing a slab of concrete of a desired thickness to be slip-formed.

4. The concrete path paver as set forth in claim 3, wherein said adjustment means comprises a pair of upturned side flanges extending from opposing sides of said horizontal member, each said side flange including a slot for receiving a threaded fastener from said side walls therethrough for secure adjustable connection of said upturned side flanges to said side walls.

5. The concrete path paver as set forth in claim 4, further comprising a vibrator for vibrating said rear wall of said box.

6. The concrete path paver as set forth in claim 4, further comprising a platform extending horizontally across the rear of said box by means of a bracket affixed to said box.

7. The concrete path paver as set forth in claim 4, wherein said front wall is inwardly sloped.

8. The concrete path paver as set forth in claim 5, further including a plurality of vertically disposed reinforcements extending from said plate and said skids to increase the strength thereof.

9. The concrete path paver as set forth in claim 6, wherein said screed extends substantially between said opposing side walls.

10. The concrete path paver as set forth in claim 7, wherein said plate extends beyond said opposing side walls of said box over a forwardmost edge of said skids.

* * * * *